United States Patent [19]

Foster et al.

[11] 4,266,219

[45] May 5, 1981

[54] SUPERVISORY CONTROL SYSTEM FOR A SMOKE DETECTOR

[75] Inventors: Ronnie D. Foster; Max R. Dickerson, both of Dublin, Ga.

[73] Assignee: Baker Industries, Inc., Parsippany, N.J.

[21] Appl. No.: 943,095

[22] Filed: Sep. 18, 1978

[51] Int. Cl.[3] ..... G08B 17/10

[52] U.S. Cl. ..... 340/630; 250/574; 340/506; 340/636

[58] Field of Search ..... 340/628, 630, 506, 507, 340/516; 250/573, 574; 356/438, 439

[56] References Cited

U.S. PATENT DOCUMENTS

| | | | |
|---|---|---|---|
| 2,877,453 | 3/1959 | Mendenhall, Jr. | 340/630 |
| 3,316,410 | 4/1967 | Meili et al. | 340/630 X |
| 3,928,849 | 12/1975 | Schwarz | 340/516 X |

*Primary Examiner*—John W. Caldwell, Sr.
*Assistant Examiner*—Daniel Myer
*Attorney, Agent, or Firm*—James J. Jennings

[57] ABSTRACT

The present invention is particularly useful with an optical smoke detector system of the Tyndall type. The system includes a chamber, an emitter for periodic energization to provide radiation within the chamber, and a sensor for providing an electrical information signal related to the amplitude of radiation passing from the emitter. In the absence of particles of combustion, radiation impinges on the sensor at a reference level. When particles enter the chamber they are struck and diffuse the radiation from the emitter, raising the level of the signal produced by the sensor. The invention includes a supervisory arrangement for checking the normal pulse received by the sensor when no particles are in the chamber, thus checking the efficacy of the emitter and sensor as well as the chamber operation. When a filter and amplifier are connected to process the signal from the sensor, the supervisory circuit can be connected to the output side of the amplifier and thus also monitor the operability of these components. The system also supervises the adequacy of the energizing potential.

3 Claims, 10 Drawing Figures

FIG. 1
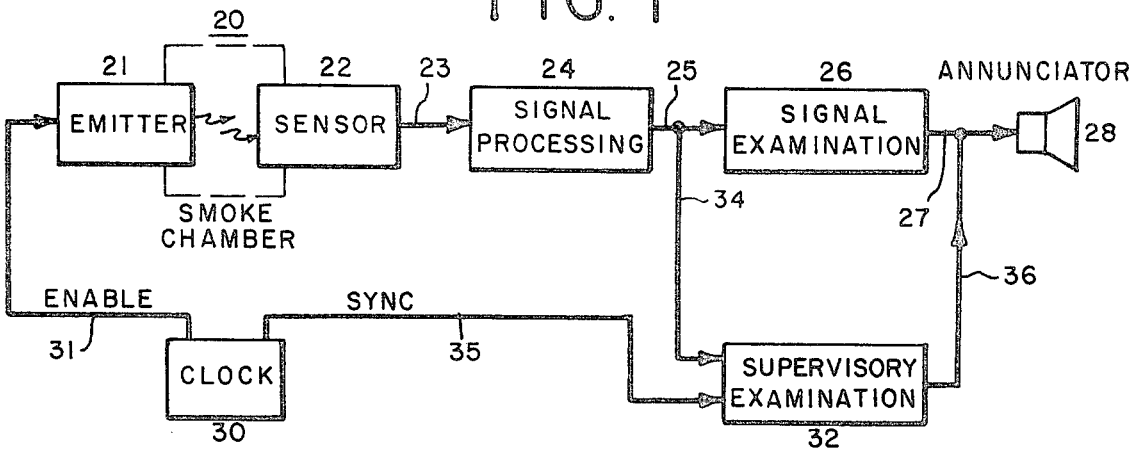
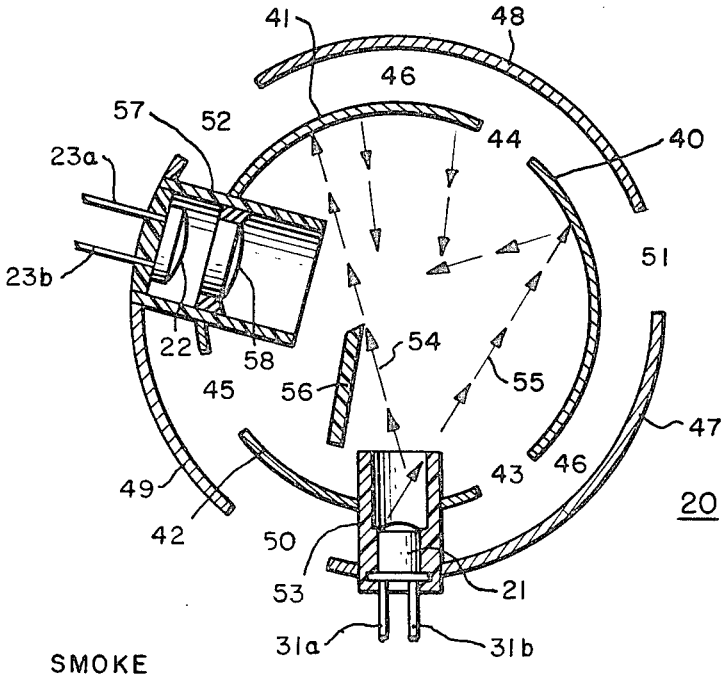
FIG. 2
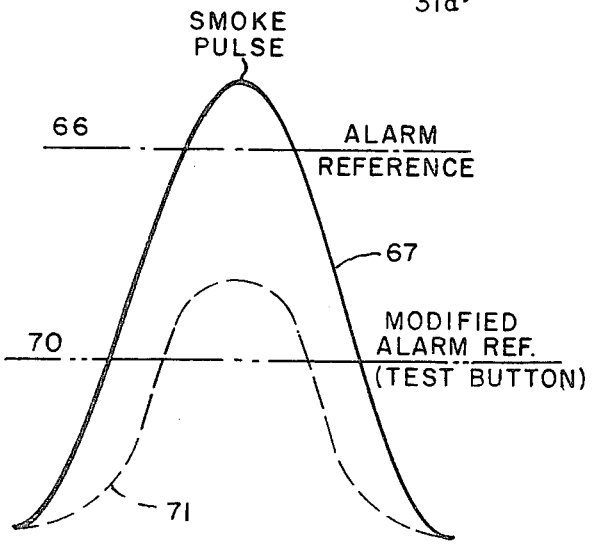
FIG. 4
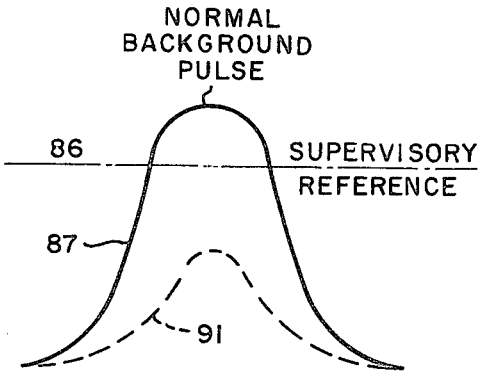
FIG. 5

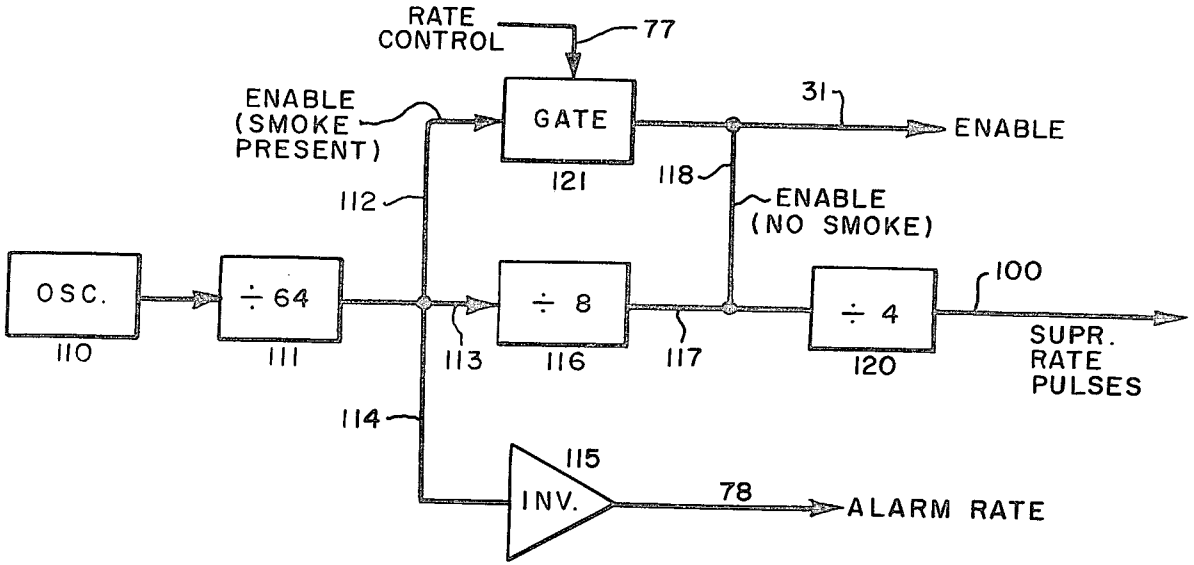
FIG. 6
MASTER CLOCK 60
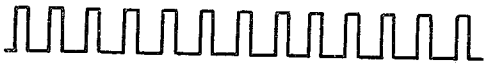
FIG. 7
ENABLE PULSES IN SMOKE CONDITION
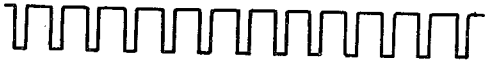
FIG. 8
ALARM RATE PULSES
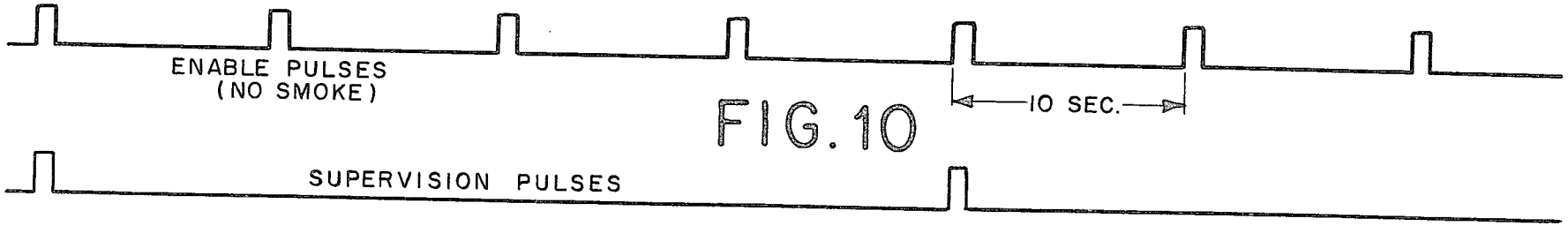
FIG. 9
FIG. 10
SUPERVISION PULSES

SUPERVISORY CONTROL SYSTEM FOR A SMOKE DETECTOR

BACKGROUND OF THE INVENTION

Various types of optical smoke detectors have been known for some time. The obscuration type detector includes an emitter or lamp for producing light within a chamber, and a sensor (such as a photocell or photodiode) also positioned within the chamber to provide an electrical output signal as a function of the radiation incident on the sensor. As particles of combustion enter the chamber and reduce the amount of radiation impinging on the sensor, the electrical output signal from the sensor is reduced to indicate the presence of smoke in the chamber. Another type of optical detector is the Tyndall effect detector. The Tyndall phenomenon refers to the visible scattering or diffusion of radiation along the beam when particles are struck by the beam. The diffusion or scattering of light produced when particles of combustion enter the beam actually increases the level of radiation impinging on the sensor, thus producing an increase in the information signal utilized to determine the presence of particles of combustion.

Different types of optical detectors have been utilized in recent years. One very effective type of detector utilizing the Tyndall effect is described and claimed in the abandoned application of Richard Roy Saltzgaber entitled "Smoke Detector Chamber and System", filed Apr. 19, 1978, Ser. No. 897,970, and assigned to the assignee of this invention. When utilizing such an arrangement, it is desirable to know that the system is in fact functioning well, including the operability of the emitter and sensor used in connection with the smoke chamber itself.

It is therefore a primary object of the present invention to provide a supervisory or monitoring system for an optical detector, effective to check the operability of the components directly associated with its smoke chamber.

It is also desirable to minimize the spurious triggering of the system by stray signals and likewise to enhance the amplitude of the signal received from the sensor. To this end the smoke detector systems frequently use bandpass filters and amplifiers, or related signal processing arrangements, between the output of the sensor and the point at which the signal is evaluated to indicate the presence of smoke in the chamber. Of course such additional signal processing circuits are also susceptible to aging or other breakdowns.

It is therefore another important object of the present invention to provide a supervisory examination arrangement which, in addition to monitoring the chamber emitter and sensor, similarly checks the effectiveness of the signal processing circuits.

Many of the smoke detector units sold today are powered by batteries. Because the system circuitry is generally comprised of semiconductors there is little drain on the battery from the normal system components. However, if the addition of supervisory circuitry is not carefully done, then the advantages to be obtained by monitoring the system might be offset by adding an undue drain on the battery or other source of energizing potential difference.

It is thus another important object of the present invention to provide a supervisory examining system for a smoke detector which is activated only periodically, to minimize the drain on the battery, but with sufficient frequency to ensure prompt discovery of a failure in the system component.

Yet another important object of the invention is the provision of a supervisory examination circuit which also checks the level of the voltage supplied to the system after the battery voltage drop is considered.

SUMMARY OF THE INVENTION

The present system is particularly useful with a smoke detector system including a chamber constructed to admit air and particles of combustion, an emitter for periodic energization to produce radiation in the chamber, and a radiation sensor for producing an electrical information signal having at least one characteristic (such as amplitude) which varies as a function of the level of radiation striking the sensor. Signal processing means is coupled to the sensor, and a signal examination means is coupled to the signal processing means for examining the signal characteristic to provide an alarm when such examination indicates presence of particles of combustion in the chamber. Some means (such as an annunciator) is provided to utilize the alarm signal to initiate or control a desired function.

Particularly in accordance with the invention, the system also comprises a supervisory examination means coupled between the sensor and the means for utilizing the alarm signal. The supervisory examination means examines the characteristic of the information signal to evaluate the condition of the emitter and sensor associated with the chamber, thus ensuring this part of the system is in good working order.

In accordance with another aspect of the invention when signal processing means (such as a filter, amplifier, or other circuit) is coupled to the sensor, then the supervisory examination means is coupled between the signal processing means and the means for utilizing the alarm signal, thus also monitoring the condition of the signal processing means.

In accordance with another feature of the invention, the supervisory examination means is activated only periodically and is synchronized with one of the periodic emitter energizations, thus monitoring the system with a minimum power drain.

THE DRAWINGS

In the several figures of the drawings, like reference numerals identify like components, and in those drawings:

FIG. 1 is a block diagram of a smoke detector system including the supervisory examination system of this invention;

FIG. 2 is a simplified showing of major parts of a smoke chamber useful in connection with the present invention;

FIGS. 4 and 5 are illustrative graphical illustrations, useful in understanding operation of the present invention;

FIG. 6 is a functional block diagram depicting one arrangement for implementing the master clock shown in FIG. 3; and FIGS. 7, 8, 9 and 10 are timing diagrams useful in understanding operation of the present invention.

DETAILED DESCRIPTION OF THE INVENTION

Figure 3:
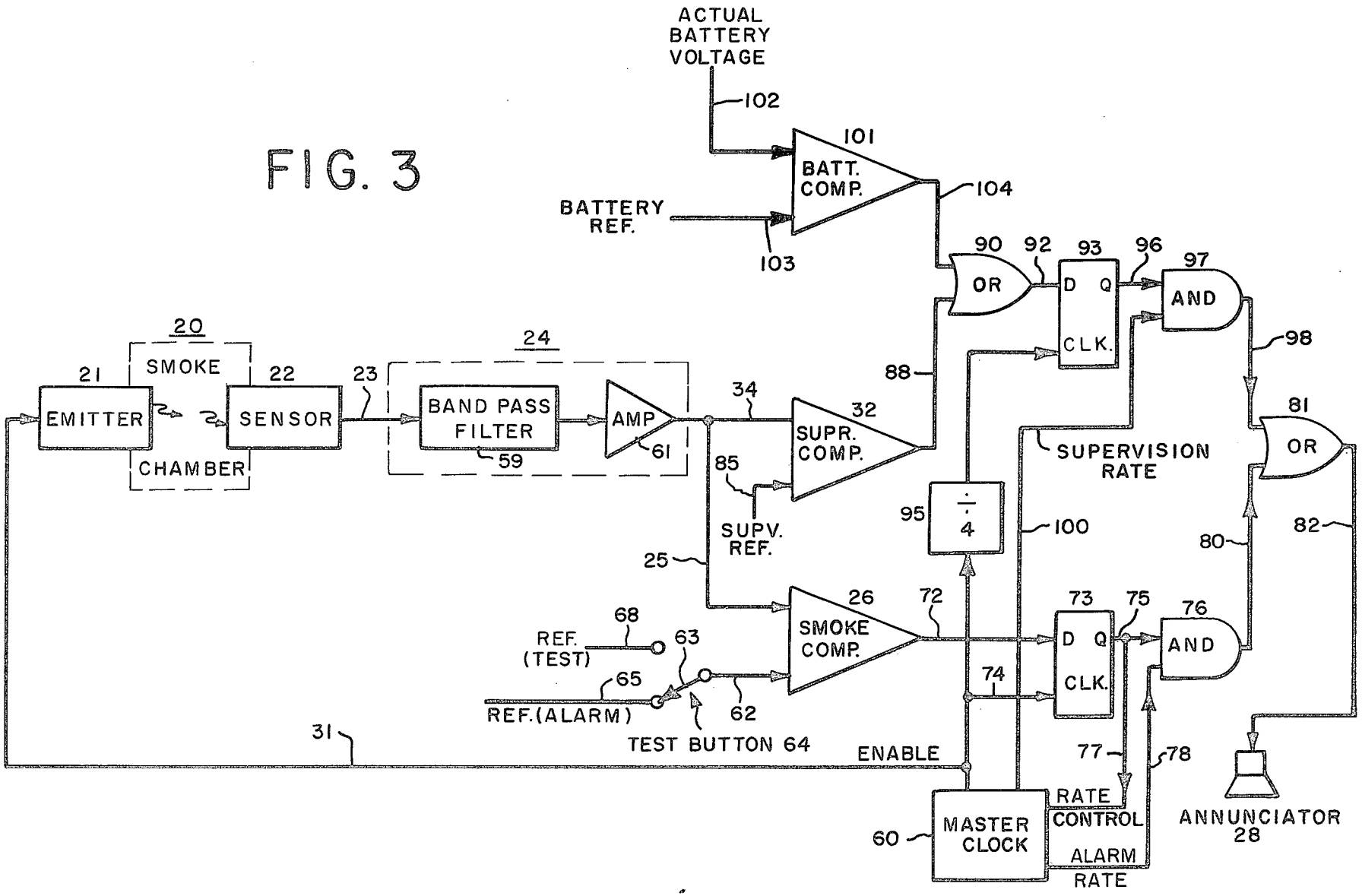
FIG. 3 is a block diagram, related to the showing of FIG. 1 but including the supervisory examination portions of the present invention in more detail.

In FIG. 1 the components of the known system, to be supervised by the arrangement of this invention, are generally shown along the upper line. That is, the smoke detector system includes a chamber 20 constructed to admit air and particles of combustion, as will be better seen in connection with FIG. 2 and explained hereinafter. In FIG. 1 an emitter 21 is positioned so that upon periodic energization, radiation is produced within smoke chamber 20. Similarly sensor 22 includes a portion extending into the chamber and sensitive to radiation in the same portion of the spectrum as that produced by the emitter 21. Hence sensor 22 is operable to produce on line 23 an electrical information signal having at least one characteristic or parameter which varies as a function of the level of the radiation impinging on the sensor. Generally this characteristic or parameter is the amplitude of a signal, and in a Tyndall type detector, the amplitude will increase as particles enter the chamber and diffuse or scatter the light produced by emitter 21. The information signal is passed through a signal processing means or circuit arrangement 24, and over line 25 to a signal examination circuit 26. The signal processing means 24 can include a bandpass filter to minimize spurious noise or radiation signals, an amplifier, to enhance the signal level, and/or other circuits. The signal examination circuit generally entails a comparison circuit for providing a contrast between the level of the signal on line 25 and a reference level established from the power supply which energizes the entire system. When the information signal on line 25 exceeds the reference level established within the signal examination circuit 26, an alarm signal is passed over line 27 to the annunciator 28. Of course the annunciator represents only some means for utilizing the signal on line 27. Other functions, such as a visual indication of the location at which the particles were sensed, a remote actuator to initiate operation of a sprinkling system, or other units can be employed in place of annunciator 28. In general such systems have also used an oscillator or clock 30 to provide a signal over line 31 for energizing or enabling the emitter 21 at periodic intervals. If this energization is done once every 10 seconds of so, for only a brief period of the order of tens or hundreds or microseconds, then the presence of particles of combustion will still be detected very rapidly without putting a constant drain on the power supply, particularly when it is a battery.

Particularly in accordance with the present invention, a supervisory examination means 32 is coupled in the circuit as shown, being basically in parallel with the signal examination arrangement 26. In general this supervisory examination means also utilizes a comparator circuit, to determine if a signal of predetermined amplitude is received at the input side of this circuit shortly after the emitter 21 is energized by an enable pulse from the clock circuit 30. The signal of predetermined amplitude is generated in the absence of particles and is referred to as background light in the above-identified copending application. This background light, which is usually considered a detriment in Tyndall effect detectors, thus has a two-fold purpose. It not only enhances the signal in the presence of particles, as cited herein, it also makes possible the supervision of the chamber and associated circuitry. Although the supervisory examination circuit 32 could be coupled directly to the output side of sensor 22, and provide effective monitoring of the smoke chamber with the emitter and sensor, a significant advantage is obtained by coupling the supervisory circuit 32 over line 34 to the output side of the signal processing arrangement 24. In this way not only are the emitter, sensor and other chamber components effectively monitored, but also all the additional electrical components in the signal processing chain are checked for effective operation every time a sync pulse is passed over line 35 from the clock in conjunction with an enable pulse over line 31 to the emitter. With an indication that there is no defect in the system being supervised, there is no output signal over line 36 to trigger annunciator 28. However when the signal on line 34 indicates there is some defect between the enable signal appearing on conductor 31 and the information signal present on conductor 34, then a signal is provided over line 36 to produce a trouble signal output from the annunciator. It is noted that the sync signal need not be provided as often as the enable signal is passed over line 31 to the emitter. For example in the preferred embodiment the sync signal was provided with every fourth enable signal, thus in effect examining the components in the system every forty seconds even though the chamber components were checking for particles of combustion every ten seconds. This is another important aspect of the invention, in that effective monitoring of the system components is provided with a minimum of power drain on the battery or other energy source.

FIG. 2 illustrates major components of the smoke chamber 20, looking downwardly in the chamber with the top half removed. Of course a complete description of the chamber and its operation is given in the above-identified copending application. The chamber itself is the interior portion shown in FIG. 2 between the curved wall segments 40, 41 and 42. Together these wall segments define an inner circular wall with inlets 43, 44 and 45 for receiving particles of combustion passing along the annular passage 46 defined between the inner wall portions 40–42 and the three curved outer wall segments 47, 48 and 49. These outer, arcuate walls also define openings 50, 51 and 52. Thus any particles exterior to the chamber can pass through the outer openings 50–52, traverse a portion of the passage 46, enter the chamber through the inner openings 43–45, and after causing the radiation level to increase when the emitter 21 is pulsed, can follow a similar path to exit the chamber.

A cylindrical tube 53 is provided as shown to support the emitter 21, and also to direct the radiation when the emitter is pulsed generally between the lines indicated by the arrows 54 and 55. The radiation from the emitter is blocked by the barrier 56 from reaching the sensor 22 in a straight line. Another cylindrical tube 57 is provided as indicated to support both the sensor 22 and a conventional condensing lens 58. Thus any radiation which enters the chamber from the emitter 21 is bounced off the portions of the inner arcuate walls 40 and 41 as indicated, and some is also returned from the outer curved wall section 48 to pass backwardly through the chamber. When particles enter the chamber and cause this light to scatter or diffuse, the radiation level incident on sensor 22 is a function not only of the direct beam radiation from emitter 21 but also the background radiation produced by the beam reflected from the curved inner walls of the chamber.

FIG. 3 depicts the added circuit components for carrying out the supervisory examination of the system in accordance with this invention. Master clock 60 includes functions in addition to the simple oscillator arrangement represented by the clock 30 in FIG. 1. Such functions will be explained in more detail below. For the present, it is sufficient to indicate that master clock 60 provides periodic enable pulses over line 31 to the emitter 21 of the smoke chamber 20. Sensor 22 is connected as shown in FIG. 1, to provide an electrical information signal on line 23 having some parameter which varies as a function of the radiation incident on sensor 22. Signal processing circuit 24 includes a bandpass filter 59 and amplifier 61. The bandpass filter passes signals within a narrow frequency range, corresponding to the peak response of sensor 22 which senses radiation within the smoke chamber. This prevents spurious and unwanted triggering of the system by stray noise signals.

The information signal on line 25 is passed to one input connection of a smoke comparator 26, shown more generally as a signal examination circuit in FIG. 1. The other input connection of comparator 26 receives a signal from line 62, which is coupled to the movable contact 63 of a test switch 64. As shown, movable contact 63 engages a fixed contact which is connected to a conductor 65, over which a reference voltage is applied. The reference voltage or alarm reference level is represented by the dash-dot line 66 in FIG. 4. This figure illustrates the average amplitude of a smoke pulse by curve 67, that is, the average amplitude of an information signal produced on line 25 when smoke is present in chamber 20 and emitter 21 is pulsed. When test button 64 is actuated, it displaces the movable contact to engage the other fixed contact, which is coupled to conductor 68. A different reference voltage is applied to conductor 68, as indicated by the dash-double-dot line 70 in FIG. 4. This line or voltage level is below the amplitude of the normal background pulse signal depicted by curve 71 in FIG. 4. The curve 71 illustrates the average signal received when emitter 21 is pulsed to produce a signal from sensor 22 at a time when there are no particles of combustion within chamber 20.

The output signal from comparator 26 is passed over line 72 to the D input of a flip-flop 73. This flip-flop circuit also receives a clock signal over line 74 from the master clock, and this clock signal is at the same rate as the frequency of the enable pulses on line 31 on the emitter. The output from the Q connection of flip-flop 73 is passed over line 75 to one input connection of AND circuit 76, and the same signal from the Q output is passed over line 77 as a rate control signal to master clock 60. It will become apparent that the effect of the rate control signal is to increase the frequency of the enable or energizing pulses applied over line 31 to the emitter when smoke is detected. Alarm rate pulses are provided by the master clock, and passed over line 78 to the other input connection of AND gate 76. The function of the alarm rate pulses is to provide a virtually constant signal from AND gate 76 over line 80 to one input connection of OR gate 81, which signal is then passed over line 82 to operate annunciator 28.

In the center of FIG. 3 is a supervisory comparator circuit 32, which is shown more generally as the supervisory examination circuit in FIG. 1. As shown in FIG. 3, the supervisory comparator circuit 32 receives the normal information signal over line 34, and at its other input connection, shown coupled to a conductor 85, receives a supervisory reference voltage signal, as represented by the dash-dot line 86 in FIG. 5. Curve 87 in FIG. 5 represents the signal received on line 34 when emitter 21 is pulsed and there are no particles of combustion in the smoke chamber. This signal, corresponding to a normal background pulse, is identical to that depicted by curve 71 in FIG. 4. Thus as long as the components which are periodically energized to detect particles of combustion and produce a normal background pulse are functioning normally, providing a signal on line 34 above the level 86, this prevents a signal issuing from supervisory comparator 32 over line 88 to one input connection of OR gate 90. However, if there is some degradation of a component or signal, and the level of the information signal received over line 34 drops to a lower level such as that indicated by the dashed line 91 in FIG. 5, then the supervisory comparator 32 provides a signal which passes through OR gate 90, and is applied over conductor 92 to the D input of flip-flop 93. The clock input connection of this flip-flop receives a signal over conductor 94 from a divide-by-four circuit 95, which is coupled to conductor 74. Hence the rate at which flip-flop 93 is clocked is one-fourth that at which the emitter 21 is energized and at which flip-flop 73 is clocked when no smoke is present. The output of flip-flop 93 is applied over conductor 96 to one input connection of AND circuit 97, the output of which is passed over conductor 98 to the other input connection of OR gate 81. The other input connection of AND gate 97 receives a supervisory rate signal over conductor 100 from the master clock 60. This signal is also at one-fourth the rate at which the emitter is pulsed under normal operating conditions.

In the upper portion of FIG. 3 is a battery comparator circuit 101. This circuit receives a signal over line 102 which is a function of the actual battery voltage, at the time this system is pulsed. Hence the level of this signal indicates adequacy of the power supply under operating conditions. As the battery ages and its internal resistance builds up, it may appear to have an adequate voltage level under no-load conditions, but the testing of the battery voltage at the energizing time insures effective monitoring of this component. A battery reference signal is applied over line 103 to the other input connection of comparator 101. When the actual battery voltage falls below the reference voltage on line 103, the battery comparator circuit provides an output signal on line 104 which is passed through OR gate 90 to the upper input connection of flip-flop 93. Hence flip-flop 93 can receive a "trouble" indication at its D input connection either in response to a too low signal at the supervisory comparator 32 when the system is pulsed, or a low battery voltage as indicated by the signal on conductor 102.

The operation of the supervisory control arrangement shown in FIG. 3 will now be described in connection with FIGS. 6–10. FIG. 6 shows one way to implement the master clock function, providing the different signals at different frequencies from a common oscillator. This showing will enable those skilled in the art to practice the invention with a minimum of experimentation. The various signals produced by master clock 60 have different frequencies, and these different signals are depicted in FIGS. 7–10.

The master clock includes oscillator 110 as shown in FIG. 6. In a preferred embodiment the oscillator produced signals at 50 hertz, or pulse signals at 20 millisecond intervals. Each pulse duration was 120 microseconds in this preferred embodiment. Of course, other frequencies and/or pulse widths can be used in implementing the invention but these figures provide pulses at times useful in controlling operation at practical time differences. The 50 hertz pulses were passed through a divide-by-64 stage 111, to provide on lines 112, 113 and 114, pulse signals with about 1.25 second intervals.

This is the frequency of enable pulses when smoke is present, and these pulses are illustrated generally in FIG. 7. Inverter 115 is effective to invert this pulse train, to provide the signals at the alarm rate as shown in FIG. 8.

A divide-by-8 circuit 116 is connected to conductor 113 to provide on conductor 117 a train of pulses at approximately 10 second intervals, as shown in FIG. 9. These pulses are passed over line 118 to line 31, providing the enable pulses under normal or no-smoke conditions of the system. A divide-by-4 circuit 120 is coupled to conductor 117, to divide down the enable pulses and provide the supervisory rate pulses on conductor 100 at approximately 40 second intervals, as shown in FIG. 10. The rate control signal on line 77 is applied to gate circuit 121. This gate is normally closed, blocking the pulses of the frequency shown in FIG. 7, so that the enable pulses on line 31 will be derived from the output of divide-by-8 circuit 116. However, when flip-flop 73 (FIG. 3) switches, this provides a rate control signal on line 77 which opens gate 121 in FIG. 6, allowing pulses at the frequency shown in FIG. 7 to pass over line 31 to the emitter 21. This means that under smoke-present conditions, the emitter is triggered 8 times more rapidly than it would otherwise be energized, to check the chamber every 1.25 seconds for the continued presence of smoke or particles of combustion. If no smoke is present, for three successive energizations of emitter 21 the sensor will provide a background level information signal on line 23, but there will be no supervision pulse to provide a gate signal to one input connection of the AND gate 97. However, FIGS. 9 and 10 show that the fourth supervision pulse coincides with an enable pulse under no-smoke conditions, and thus the system operation will be checked at a frequency lower than the reference frequency at which the emitter is normally energized.

TECHNICAL ADVANTAGES

The supervisory control system of the present invention has a significant advantage when used in connection with a Tyndall effect detector. Those skilled in the art appreciate that the background light associated with such a detector is generally considered a drawback. However, in accordance with this invention, this background signal is utilized to supervise not only the chamber components but the signal processing arrangement. As explained in connection with FIG. 5, by providing a supervisory reference signal below the amplitude of the normal background pulse, the system determines that all the components between the emitter and the input side of the supervisory examination circuit are operating properly. Moreover the supervision pulses occur at a supervisory frequency which is much lower than the reference frequency at which the emitter is periodically enabled in the absence of smoke particles in the chamber. This is graphically displayed in FIGS. 9 and 10. In this way the major components and circuitry of the normal system are checked with a minimum drain on the battery or other energy supply.

In the appended claims the term "connected" means a d-c connection between two components with virtually zero d-c resistance between those components. The term "coupled" indicates there is a functional relationship between two components, with the possible interposition of other elements between the two components described as "coupled" or "intercoupled".

While only a particular embodiment of the invention has been described and claimed herein, it is apparent that various modifications and alterations of the invention may be made. It is therefore the intention in the appended claims to cover all such modifications and alterations as may fall within the true spirit and scope of the invention.

What is claimed is:

1. A smoke detector system including a chamber constructed to admit air and particles of combustion, an emitter for periodic energization at a reference frequency to produce radiation in the chamber, a radiation sensor for producing an electrical information signal the amplitude of which varies as a function of the level of radiation striking the sensor, signal processing means coupled to the sensor, signal examination means coupled to the signal processing means for examining the amplitude of the information signal and for providing an alarm signal when such examination indicates presence of particles of combustion in the chamber, and an annunciator for utilizing the alarm signal to control a desired function, and further comprising a supervisory examination circuit coupled to the output side of the signal processing means, for examining the amplitude of the information signal to evaluate the operability of the emitter and sensor associated with the chamber, and to evaluate the operability of the signal processing means, which supervisory examination circuit is connected to pass a signal to the annunciator when a malfunction of the system is detected.

2. A smoke detector system as claimed in claim 1, and further comprising means for activating said supervisory examination means only periodically at a supervisory frequency less than said reference frequency and in synchronism with one of the periodic emitter energizations, so that the signal passed to the annunciator from the supervisory examination circuit is at the supervisory frequency.

3. A smoke detector system as claimed in claim 2, and further comprising means for energizing the annunciator by the alarm signal at an alarm frequency substantially higher than said supervisory frequency, affording ready distinction between the alarm condition and system malfunction condition.

* * * * *